United States Patent [19]

Benedict

[11] 4,088,049

[45] May 9, 1978

[54] MATERIAL CUTTING APPARATUS

[76] Inventor: John P. Benedict, 7026 Kildare, Cote St. Luc, Montreal, Quebec, Canada

[21] Appl. No.: 630,702

[22] Filed: Nov. 10, 1975

[51] Int. Cl.[2] ..... B26D 7/26; B26D 5/10

[52] U.S. Cl. ..... 83/240; 83/277; 83/433; 83/471.2; 83/486; 83/614; 83/649

[58] Field of Search ..... 270/30, 31; 83/87, 88, 83/267, 433, 471.2, 485, 486, 563, 588, 648, 649, 175, 277, 614, 240

[56] References Cited

U.S. PATENT DOCUMENTS

| | | | |
|---|---|---|---|
| Re. 27,538 | 12/1972 | Martin et al. | 83/87 X |
| 794,060 | 7/1905 | Uzel | 83/485 X |
| 1,521,284 | 12/1924 | Dorman | 270/30 |
| 2,211,082 | 8/1940 | Smith | 83/486 |

*Primary Examiner*—Willie G. Abercrombie
*Attorney, Agent, or Firm*—Alan Swabey & Co.

[57] ABSTRACT

An improved material cutting apparatus of laying and cutting material. The improved apparatus is of simple construction, requires only one workman to operate the apparatus, and minimizes wastage of material. The apparatus is also readily adaptable to existing carriage structures utilized for laying material on a cutter board. The improved apparatus, when mounted on a carriage unit, can be moved along a cutter board to any desired location. The apparatus includes a cutter supported by a bracket structure, the bracket structure being slidably mounted on rail means. The cutter can be manually advanced along the rail means in order to perform a straight cut of the material being laid on the cutter board.

14 Claims, 4 Drawing Figures

MATERIAL CUTTING APPARATUS

BACKGROUND OF THE INVENTION

1. Field of the Invention

The present invention relates to an improved material cutting apparatus of laying and cutting material including cloth, leather and vinyl.

2. Description of the Prior Art

Numerous devices have been disclosed in the prior art for cutting cloth, these devices varying considerably in their construction and complexity. For example, U.S. Pat. No. 2,503,353 to Pugh discloses a cloth cutting apparatus wherein cloth to be cut is engaged by means adapted to stretch the cloth in the path of a cutting element as the cutting element is advanced along guide rails. Such a structure necessitates the laying of the cloth over top of the apparatus prior to effecting the cutting operation. As a result, the use of such an apparatus results in a cutting operation which is quite slow and therefore completely impractical in industry today.

The use of stationary devices in association with a cutting table are well known in the prior art. For example, U.S. Pat. No. 1,235,459 discloses a leather cutting machine used particularly for making harnesses. This patent discloses the use of a cutter board having a pivotally mounted support structure for a cutter carriage consisting of a sliding block having a lower groove to receive a longitudinal rib. The longitudinal rib forms a guide for the cutter carriage which can be manually advanced across the width of the cutter board. The use of such a stationary apparatus necessitates the laying of the material relative to the apparatus, thereby limiting the use of such an apparatus to one location on the cutter board. As a result, in the case of a lay of material which is generally 50 to 60 feet, but may be any desired length, any damaged portions of the material in the length thereof must be removed manually using scissors. However, the use of scissors is both time consuming and, in the case of a normal width of material, requires the laying operation to be performed by at least two workmen. Further, when cutting the damaged portion of material from the lay, the cut obtained frequently varies from a line perpendicular to the edge of the lay. As a result, wastage of two to six inches of material can occur in each lay. Considering that there may be seventy lays of material on the cutter board before the cutting out operation of the patterns is commenced, it is apparent that the losses in material costs alone can be substantial when using scissors.

SUMMARY OF THE INVENTION

The present invention proposes to overcome the above drawbacks by providing a cutting apparatus which is quite simple in construction, which only requires one workman to operate the same, and minimizes the wastage of material. Additionally, the invention according to the present application is readily adaptable to existing carriage structures utilized for laying the material on the cutter board. As such, the present invention does not necessitate a substantial capital outlay or complete modification of existing manufacturing methods which might otherwise render its use prohibitive.

According to the present invention, there is provided a material cutting apparatus comprising: a pair of spaced-apart arm structures adapted to be connected to an existing carriage unit which is movably mounted on a cutter board, the carriage unit supporting a roll of material to be laid on the cutter board as the carriage unit is moved along the cutter board, the arm structures supporting rail means adapted to extend a width of the material being laid from the roll of material onto the cutter board, and at right angles to a length of the material being laid; a bracket structure slidably mounted on the rail means, the bracket structure adapted to be advanced along the rail means across the width of the material being laid on the cutter board; the bracket structure supporting a cutter, the cutter adapted to cut the material being laid onto the cutter board; the material cutting apparatus, when mounted on the carriage unit, adapted to be moved along the cutter board so as to permit the cutting of material by means of the cutter at any location on the cutter board along the length of the material being laid, the bracket structure and cutter when manually advanced along the rail means adapted to cut the material along a straight line perpendicular to the length of the material, minimizing wastage of material and increasing the rate at which material can be laid on the cutter board.

Further, according to the present invention, there is provided a method of laying and cutting material comprising the steps of: (a) manually placing a lay of material on a cutter board from a roll of material situated on a carriage unit as the carriage unit is manually advanced along a length of the cutter board; (b) stopping the carriage unit at a location of a defect in the material being laid; (c) lowering a cutter supported by the carriage unit into engagement with an edge of the material adjacent the defect, actuating the cutter, and manually advancing the actuated cutter across the width of the material along a rail means supporting the cutter; (d) performing a second cut of material to remove a strip therefrom containing the defect; (e) raising the cutter to an elevated position above the material being laid; and (f) continuing to lay the material from the roll beginning with a slight overlap of the edge of the material where the first cut was made to remove the defect therein.

BRIEF DESCRIPTION OF THE DRAWINGS

In drawings which illustrate one embodiment of the present invention.

DESCRIPTION OF THE PREFERRED EMBODIMENTS

Figure 1:
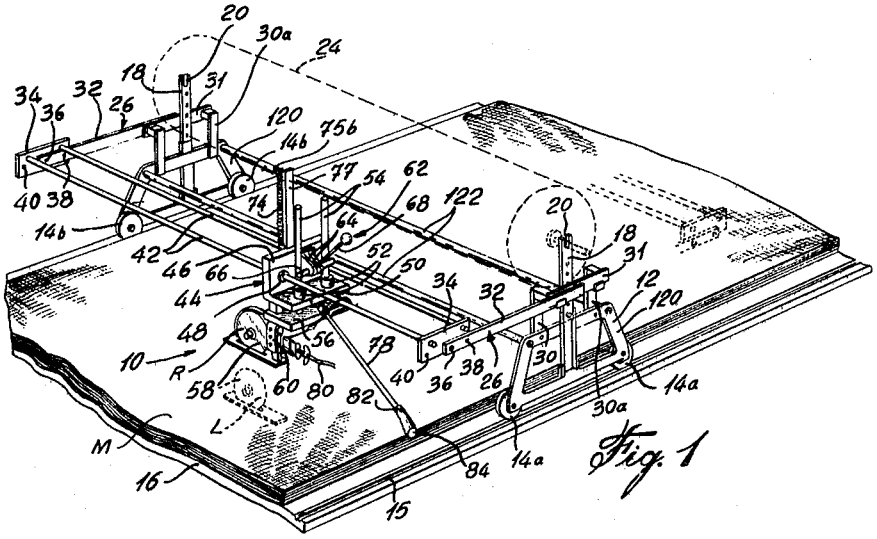
FIG. 1 is a perspective view of the material cutting apparatus according to the present invention, mounted on an existing carriage unit, an operative position of the cutter being illustrated in phantom.
Figure 2:
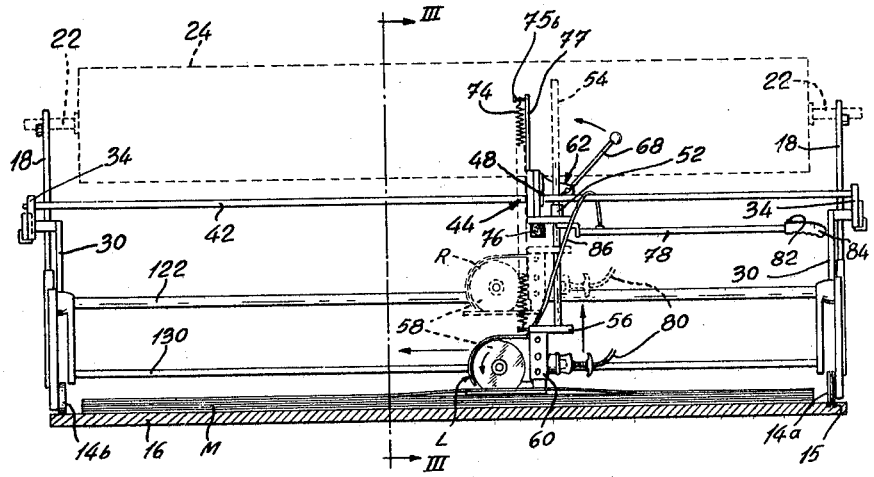
FIG. 2 is a front view of the apparatus according to FIG. 1.

As seen in the drawings, a material cutting apparatus is indicated generally by reference numeral 10 and is supported from a carriage unit 12, the carriage unit movably supported at opposite ends by two pair of wheels **14*a* and 14*b* which permit movement of the carriage unit along a length of a cutter table 16. The pair of wheels 14*a* are grooved in order to fit a guide track 15 which extends along the length of cutter table 16, adjacent the edge thereof, thereby preventing lateral movement of the carriage unit 12 on cutter table 16. The carriage unit 12 includes a pair of vertical support members 18 having U-shaped receiving slots 20 at the upper ends thereof, the slots 20 receiving the ends of a shaft 22 supporting a rotatably mounted roll of material 24 from which a lay of material is placed on the cutter board 16 as the carriage unit 12 is advanced along a length thereof. The carriage unit 12 is of conventional construction in that the same is extensively used in the textile industry for the laying of material on cutter boards. The carriage unit 12 includes a pair of end frame members 120 which are joined together by a pair of connecting rods 122, the frame members being supported by wheels 14***a* and 14*b*. A pair of bell-crank arm structures 124 are pivotally supported from one of the connecting rods 122 adjacent the support members 120 with outer ends of arm portions 124*a* of the pair of arm structures being interconnected by three parallel, spaced-apart rods 126, 128 and 130. Adjustment of the position of rods 126, 128 and 130 relative to the frame members is achieved by means of a screw fastener 132 which is secured to the frame member 120 and engages a cooperating slot 134 in arm portion 124*b* of arm structure 124. Securing of screw fastener 132 in slot 134 releasably maintains arm structure 124 in a desired position for laying of material on cutter board 16.

The cutting apparatus 10 includes a pair of arm structures 26, each including a first member 32 of which is pivotally secured adjacent one end thereof to the vertical support member 18 of the carriage unit 12 by means of a suitable fastener 28. A pair of bracket support members 30, which are also secured to the carriage unit 12, engage lower surfaces of the first members 32 of the arm structures 26 in order to support the same intermediate the respective pivot points of the first members and the outer ends thereof. A second pair of bracket support members 30*a* are located on an opposite side of the carriage unit 12 from the support members 30 in order to support the arm structures 26 when the cutting apparatus is moved to the opposite side of the carriage unit 12. The free ends of the support members 30 and 30*a* are interconnected by member 31. Relocating the cutting apparatus from one side of the carriage unit 12 to the other side is achieved by pivoting the arm structures 26 about their respective pivot points, the position of the cutting apparatus on the other side of the carriage unit being illustrated in phantom in FIG. 1.

A free end of each of the first members 32 supports a pivotally mounted plate 34 by means of a stub axle 36. A locking pin 38 is inserted through aligned openings in the first members 32 and plates 34 in order to restrict pivoting of the plate 34 relative to the first members 32 when the cutting apparatus is being utilized. The plates 34 also include second openings 40 which align with the openings in the first members 32 for insertion of locking pins 38 when the cutting apparatus is moved from one side of the carriage unit 12 to the other.

The plates 34 support a pair of spaced-apart parallel rails 42 which are circular in cross-section and extend transversely to the length of the cutter borad 16. The rails 42 support a bracket structure 44 which is slidably mounted thereon for movement along a length of the rails 42. The bracket structure 44 is L-shaped in side view, with the upstanding portion 46 thereof provided with bearings 48 to facilitate the sliding of the bracket structure along the rails 42. The base portion 50 of the L-shaped bracket structure 44 is provided with a pair of spaced-apart bearings 52 which receive vertically slidable shafts 54. A mounting plate 56 is secured to the lower ends of the pair of shafts 54 by means of set screws 57, or by any other suitable means, the mounting plate 56 being vertically movable relative to the base portion 50 of the L-shaped bracket structure 44 by means of shafts 54 in the manner described below. The mounting plate 56 supports an electrically driven cutter 58 by means of a bracket 60 which is secured to the lower surface of plate 56 by means of screws, or by other similar suitable means. The cutter 58 is of conventional construction and will therefore not be described in detail in the present application. A brake mechanism 62 is mounted on the upstanding portion 46 of the L-shaped bracket structure, the brake mechanism being provided to regulate the movemeent of the shafts 54 and mounting plate 56, together with cutter 58, relative to the bracket structure 44.

The brake mechanism 62 includes a pair of spaced-apart supports 64 which extend outwardly from the upstanding portion 46 intermediate the shafts 54. The supports 64 are provided with aligned openings which receive a shaft 66, the shaft 66 extending transversely to and slightly beyond the vertical shafts 54 as seen in FIG. 1. A lever 68 is rigidly secured to the pivotally mounted shaft 66 at a location between the supports 64, the lever 68 adapted to permit manual rotation of the shaft 66. The shaft 66 is provided with a pair of engaging means, the engaging means comprising adjustable thumb screws 70 which are so located on shaft 66 as to engage vertical shafts 54 when the lever 68 is not actuated, thereby preventing vertical displacement of cutter 58. Engagement of the ends of the screws 70 with the vertical shafts 54 function as a brake to prevent movement of the vertical shafts, and therefore the mounting plate 56 and its cutter 58, relative to the bracket structure 44 and the rails 42. To release the braking effect of the engaging means and thereby permit vertical displacement of the cutter 58, the pivotally mounted shaft 66 is manually pivoted by means of the lever 68 whereby the screws 70 are disengaged from the vertical shafts 54.

In its non-operative or raised position, indicated in the drawings by reference letter R, the cutter 58 is positioned above the material M being laid on the cutter board 16. In order to cut the material being laid on the board, the cutter 58 is manually lowered by pushing lever 68 in the direction of arrow 72 so as to disengage screws 70 from vertical shafts 54 and simultaneously pushing down on shafts 54. Once the cutter 58 is in the desired position adjacent the edge of the material being laid, the lever 68 is released by the operator, thereby retaining the cutter 58 in the lowered position indicated in the drawings by reference letter L. A return spring 74, releasably attached at one end to a pin 75*a* which is mounted on mounting plate 56 and at an opposite end to a pin 75*b* mounted on an extension 77 of bracket structure 44, is provided to permit automatic return of the cutter 58 from its lowered operative position to its raised inoperative position after the material M is cut. Since the spring 74 is stretched when the cutter 58 is lowered to its operative position, pushing lever 68 in the direction of arrow 72 after cutting the material releases the brake mechanism and permits return spring 74 to pull the cutter 58 back to its raised position. A pair of bumpers 76 are secured to the lower surface of the base portion 50 of bracket structure 44 in order to function as shock absorbers when the return spring 74 returns the mounting plate 56 and cutter 58 to their raised position. The pair of bumpers 76 also maintain a minimum spacing between the bracket structure 44 and the mounting plate 56.

A handle 78 is pivotally connected to the lower surface of the base portion 50 intermediate the bumpers 76, the handle permitting an operator to manually advance the cutter 58 across the width of the material M situated on the cutter board 16. An electrical extension cord 80 connects the cutter 58 to an overhead trolley, not shown in the drawings, which extends the length of the cutter board 16, the overhead trolley supporting the electrical cord being of known construction. A switch 82 for actuating the cutter 58 is situated in the gripping portion 84 of the handle 78; and a wire 86 extends from the switch 82, along the interior of handle 78, which is of metal tubing construction, and from an opening in the hollow handle 78 to the cutter 58.

In order to fabricate the cutting apparatus, metal plates are first selected to be used in the construction of base portion and upstanding portion of the bracket structure 44. The plates forming the upstanding portion 46 are provided with a pair of spaced-apart openings for supporting a pair of bearings 48 which facilitate sliding of the bracket structure along the rails 42. A pair of spaced-apart supports 64 are welded to the upstanding portion near the centre of the plate, the supports first having been provided with aligned openings to support the pivotally mounted shaft 66, to which is attached lever 68 by welding or means of fasteners. The shaft 66 is provided with engaging means such as set screws which are so situated on shaft 66 as to engage the vertical shafts 54 supported by the plate forming the base portion of the bracket structure 44.

Openings are drilled in the metal plate forming the base portion 50, these openings being situated between the supports 64 and the openings in the upstanding portion which supports bearings 48. These openings support a pair of bearings which receive the pair of vertical shafts 54. The handle 78 is connected by means of a universal joint or similar connection to the lower surface of the plate forming the base portion 50, and the pair of bumpers 76 are secured to the lower surface of the base portion 50.

Figure 3:
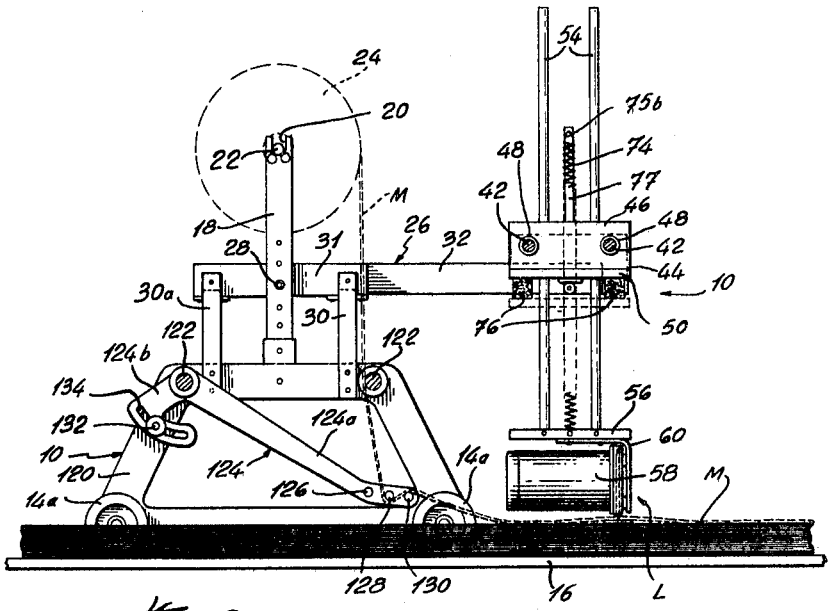
FIG. 3 is an enlarged cross-section of the apparatus, taken along the line III—III of FIG. 2.
Figure 4:
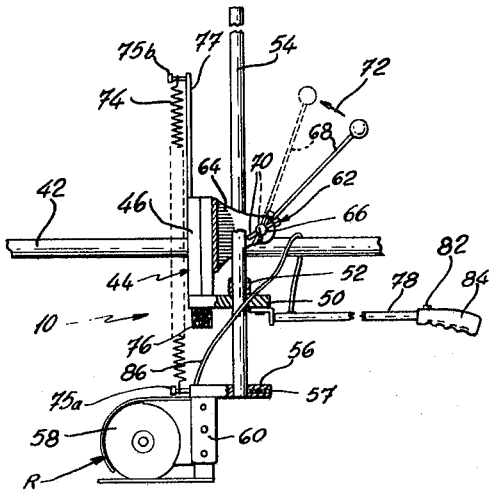
FIG. 4 is an enlarged front view of the cutting apparatus illustrating operation of the cutter raising and lowering mechanism.

The method of operating the cutting apparatus 10 and of laying the material M requires that the operator begin at one end of the cutter board 16 with the leading edge of the material M from the roll of material 24 located on the carriage unit. As best seen in FIG. 3, the material M extends downwardly from the roll 24 beneath a first rod 128 and over a second rod 130, rods 128 and 130 forming part of the pivotable arm structure 124 which is an integral part of carriage unit 12. The carriage unit 12 is then advanced by the operator along the length of the board 16. When the operator notices a defect in the material M being laid, he stops the carriage unit 12 and pulls the handle 76 with the bracket structure 44 and cutter 58 attached thereto, to one edge of the material being laid. The operator then presses the lever 68 in the direction of arrow 76 and manually lowers the cutter 58 to a desired elevation corresponding to the level of the material being laid. When the desired level is reached, the operator releases the lever 68, thereby actuating brake mechanism 62 which retains the cutter 58 at the desired level. The operator then presses the switch 82 in the gripping portion 84 of handle 78 to operate the cutter 58 and manually uses the handle 78 to push the cutter 58 across the width of the material M being laid. After the operator has cut the width of the material M, he draws the handle back to the first edge of the material M and performs a second cut of the material M in order to remove a width of material containing the defect situated therein. The operator then continues to lay material on the cutter board 16, commencing with the slight overlap of the first cut edge of the material M and continues to lay material M along the length of the cutter board.

By using the apparatus and method according to the present invention, it is possible to cut and lay material on a cutter board utilizing only one operator whereas the prior methods and apparatus have necessitated the use of at least two operators. Likewise, the amount of wastage of material is considerably minimized in that defects are removed from the material being laid by a straight cut which is perpendicular to the length of the material. This could not be achieved previously when the operators utilized scissors to remove such defects, which resulted in considerable material wastage. Additionally, the amount of time required for the one operator to perform the laying operation is considerably decreased by using the apparatus and method according to the present invention. Since the present apparatus is adaptable to existing carriage units which lay material from a roll of material located on the carriage unit, it is possible to use the present invention in association with existing equipment, thereby minimizing the capital expenditure which would be associated with complete replacement of existing equipment, such as might be necessary if a completely automated cutting and laying machine were to be used. As well, the time and expense in modifying an existing carriage unit in order to utilize the cutting apparatus are minimal.

I claim:

1. A material cutting apparatus comprising:

a pair of spaced-apart arm structures adapted to be pivotally connected to an existing carriage unit which is movable mounted on a cutter board whereby the material cutting apparatus can be moved from one side of the carriage unit to the other side thereof, the carriage unit supporting a roll of material to be laid on the cutter board as the carriage unit is moved along the cutter board, the arm structures supporting rail means adapted to extend a width of the material being laid from the roll of material onto the cutter board, and at right angles to a length of the material being laid;

a bracket structure slidably mounted on the rail means, the bracket structure adapted to be advanced along the rail means across the width of the material being laid on the cutter board;

the bracket structure supporting a cutter, the cutter adapted to cut the material being laid onto the cutter board;

the material cutting apparatus, when mounted on the carriage unit, adapted to be moved along the cutter board so as to permit the cutting of material by means of the cutter at any location on the cutter board along the length of the material being laid, the bracket structure and the cutter when manually advanced along the rail means adapted to cut the material along a straight line perpendicular to the length of the material and increasing the rate at which material can be laid on the cutter board.

2. A material cutting apparatus according to claim 1, wherein said cutter is movably mounted in a vertical direction with respect to the bracket structure whereby an elevation of the cutter can be varied.

3. A material cutting apparatus according to claim 2, wherein said cutter is movably supported by vertically extending shaft means, the vertically extending shaft means being slidably supported by said bracket structure, whereby said cutter can be raised or lowered relative to said bracket structure.

4. A material cutting apparatus according to claim 2, wherein said bracket structure is provided with a brake mechanism whereby an elevation of the cutter relative to the rail means can be maintained in a fixed position.

5. A material cutting apparatus according to claim 2, wherein biasing means are provided between the bracket structure and the cutter, whereby said cutter is biased towards said bracket structure, thereby permitting return of the cutter from a lowered position wherein cutting of the material is performed and a raised position located above the material being laid.

6. A material cutting apparatus according to claim 1, wherein the rail means comprises a pair of spaced-apart rails secured at opposite ends thereof to the arm structures.

7. A material cutting apparatus according to claim 1, wherein each arm structure includes a first member pivotally secured adjacent one end thereof to one end of the carriage unit, an opposite end of each first member supporting a plate member, the plate members supporting opposite ends of the rail means.

8. A material cutting apparatus according to claim 7, wherein the plate members are pivotally secured to the first members, with pin means engaging cooperating openings in each first member and each plate member, thereby restricting pivotal movement of the plate member relative to the first member during operation of the cutting apparatus.

9. A material cutting apparatus according to claim 8, wherein support means are mounted on the carriage unit, the support means engaging at least one first member intermediate opposite the ends thereof to maintain the arm structures and rail means in a desired position.

10. A material cutting apparatus according to claim 1, wherein said bracket structure is provided with a handle which is pivotally secured thereto, the handle adapted to facilitate manual movement of the material cutting apparatus along the rail means.

11. A material cutting apparatus according to claim 10, wherein means for actuating the cutter are provided in a gripping portion of the handle, whereby the operator can actuate the cutter while moving the cutter across the width of the material being cut.

12. A material cutting apparatus according to claim 5, wherein bumper means are provided between the cutter and the bracket structure, thereby bumper means adapted to absorb shock when the biasing means draws the cutter upwardly towards the bracket structure.

13. A material cutting apparatus according to claim 4, wherein the bracket structure is of L-shaped configuration in side view, the structure including an upstanding portion and a base portion, the upstanding portion including openings for the rail means and the base portion including openings for vertically extending shaft means which support the cutter, the upstanding portion supporting the brake mechanism for releasably engaging the vertically extending shafts to maintain the cutter in a fixed vertical position.

14. A material cutting apparatus according to claim 13, wherein the brake mechanism includes a pair of supports extending outwardly from the upstanding portion of the bracket structure, the supports having aligned openings for supporting a shaft having a lever extending outwardly therefrom, the shaft including engaging means which normally engage the vertically extending shafts to prevent movement thereof in a vertical direction, the lever adapted to be actuated to disengage the engaging means from the vertically extending shafts, thereby permitting movement of the cutter in a vertical direction only when the lever is actuated.

* * * * *